United States Patent [19]

Larson

[11] Patent Number: 4,487,152

[45] Date of Patent: Dec. 11, 1984

[54] BOAT STABILIZER

[76] Inventor: Wilfred Larson, 41244 Medway Ave., Quartz Hill, Calif. 93534

[21] Appl. No.: 482,401

[22] Filed: Jun. 24, 1974

[51] Int. Cl.[3] ..... B63B 1/24

[52] U.S. Cl. ..... 114/274; 440/66; 114/271

[58] Field of Search ..... 114/145 A, 271, 274; 440/49, 51, 66, 71

[56] References Cited

U.S. PATENT DOCUMENTS

| | | | |
|---|---|---|---|
| 2,319,640 | 5/1943 | Sink | 440/71 |
| 2,963,000 | 12/1960 | Fester | 115/17 X |
| 2,998,795 | 9/1961 | Downie et al. | 114/145 A |
| 3,099,240 | 7/1963 | Montague | 114/66.5 H |
| 3,114,343 | 12/1963 | Headrick et al. | 114/66.5 H |
| 3,139,853 | 7/1964 | McCarthy et al. | 115/17 |
| 3,211,119 | 10/1965 | Kiekhaffer | 114/66.5 H |
| 3,343,512 | 9/1967 | Rasmussen | 114/66.5 H |

FOREIGN PATENT DOCUMENTS

| | | | |
|---|---|---|---|
| 716879 | 10/1954 | United Kingdom | 115/17 |

*Primary Examiner*—Trygve M. Blix
*Assistant Examiner*—Stephen P. Avila
*Attorney, Agent, or Firm*—Edward D. O'Brian

[57] ABSTRACT

A stabilizer for boats, the stabilizer being of generally delta planform, having a positive upper camber and a negative lower camber in chordwise cross section, being mountable upon a propeller post and in adjacent spaced relation from the propeller and adapted to be submerged, the stabilizer providing a lifting force to the stern, a downward force to the bow and a generally stabilizing affect upon the boat to which it is adapted.

8 Claims, 14 Drawing Figures

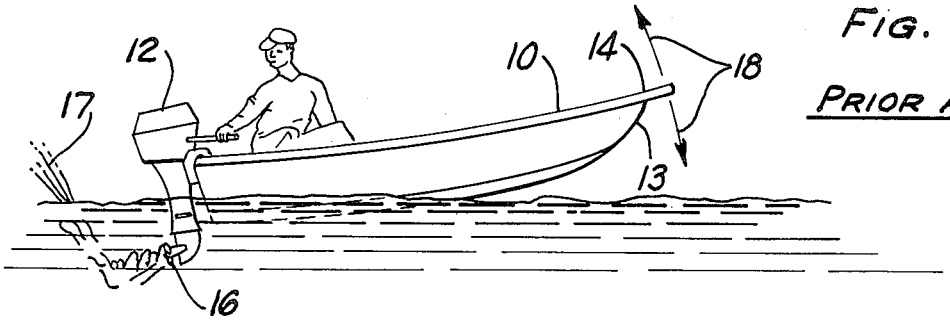
FIG. 1
PRIOR ART
FIG. 2
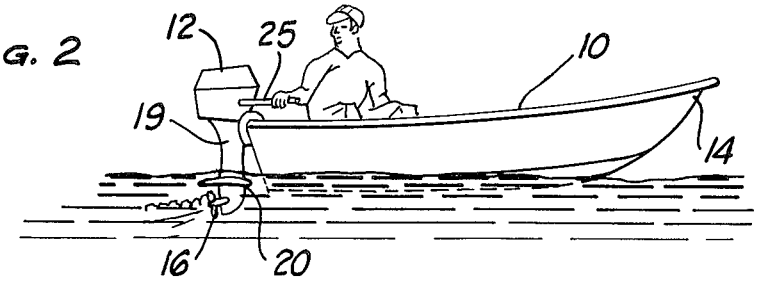
FIG. 3
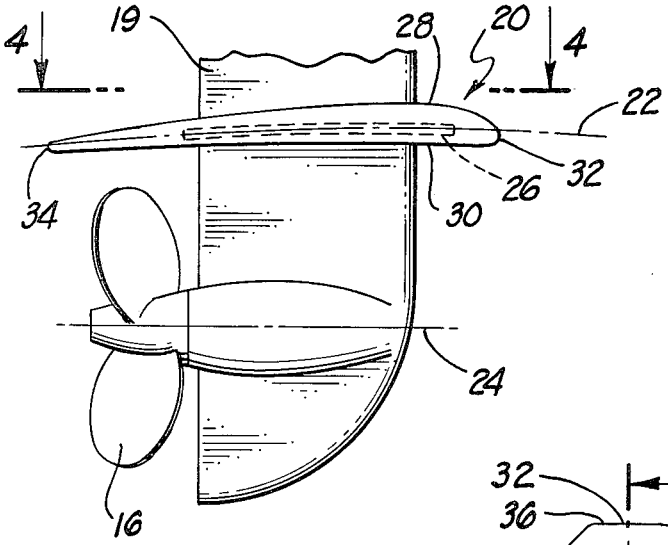
FIG. 4
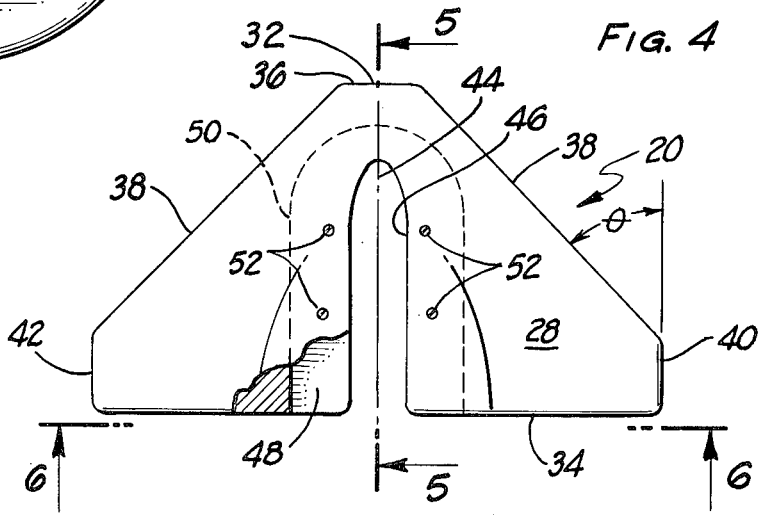

BOAT STABILIZER

BACKGROUND OF THE INVENTION

Boating enthusiasts have long been plagued with handling and ride problems associated with high speed boat performance. Although most vehicles in the pleasure and speed boat categories are vulnerable to such performance factors, outboard motor boats are particularly notorious in their tendency to assume an extremely high angle of attack, or bow-up attitude, when in relatively high speed operation. The dangers inherent in this operational attitude are obvious. Since most of the weight, usually including the boat operator, is located in the stern of the boat the raised bow blocks a major portion of the operator's view. The resultant dangers to other people or boats so unfortunate as to be in this blind spot, additional to the danger to which the boat operator and passengers are subjected, are of great concern. Indeed, many deaths and serious injuries have resulted from this deficiency in modern day boating practice. These conditions are further exaggerated when water skiers are being towed by the boat.

Some boat operators place passengers, cargo or other weighty items in the forward end of the boat in an effort to overcome this problem, forcing the nose downward by sheer weight. Many others take the rather drastic countermeasure of utilizing ballast in the forward ends of their boats. The result is a sluggish boat operation and a loss of operating efficiency due to the necessity to carry such excess weight.

Another difficulty encountered almost universally is the tendency of the boats to "gallop" or "porpoise" during medium to high speed operation. That is, the nose of the boat, in a high acceleration action, moves rapidly upward to its maximum height then downward, the hull slapping the water surface with great force and again bouncing to the upward position. This happens continuously and results in great discomfort to the boat passengers, especially those seated toward the bow. Many passengers suffer seasickness as a direct result of this undesirable boating characteristic.

The noted porpoising action of the boat, itself a condition of instability, induces and catalyzes additional instability into the boat operation, immeasurably increasing the operators boat-handling problems.

It will be recognized that when a boat is operating in the aforedescribed high angle of attack or is tending to porpoise, one of the primary inducing factors is that the stern is being forced downward to a greater depth in the water. This makes a most uncomfortable ride for the passengers. When rough water or wakes are encountered the speed of the boat must be decreased for the comfort and safety of the passengers, and to keep the cargo from being thrown about. Although the stern is the most comfortable place to ride under such conditions, the passengers cannot take advantage of it since to do so would place extra weight in the stern and prevent the boat from reaching a planing attitude. Such an operational attitude also greatly increases the power required to overcome the boat-to-water friction and to move aside a great volume of water in facilitating passage of the boat therethrough. Hence, a significant portion of the power available from the motor is wasted, useful work potential being lost in overcoming this undesirable condition. This condition is sometimes detectable by the appearance of a "rooster-tail" of water behind the boat. This is a sign that the propeller is oriented with its center line of thrust at a rather severe acute angle in relation to the water surface. The result is a considerable loss of power and operational efficiency.

This loss of functional horsepower has the further detrimental result of decreasing the boat's operating speed and increasing its fuel consumption.

It is desirable that the boat reach a "planing" mode as rapidly as possible after getting under way, thereby increasing its speed more rapidly, improving the riding quality of the boat and decreasing fuel consumption by permitting the motor to be throttled back while nevertheless effectively maintaining a good planing condition. Due to the difficulties enumerated above it has often been difficult in conventional boating activities to plane out, not to mention the improbability of maintaining the plane once it is achieved, particularly during turning maneuvers. Factually, when a boat is burdened with a relatively heavy load it is often found that planing can never be achieved.

In cases such as this the operator usually resorts to the use of excessive horsepower, the result being a considerable expenditure for a larger motor and greater fuel consumption. The use of higher horsepower motors to overcome planing deficiencies can then be expected to provide a problem is slowing the boat sufficient for troll-fishing and a greater tendency to propoise or gallop.

Many operators of ski and pleasure boats incur the additional expense of installing plates to the lower corners of the transom, such plates being variously referred to as boat lifters, levelers or cavitation plates. They are forced downward into the water, acting as wedges against the water and lifting the stern of the boat. While some such plates are fixed in specific positions, others are moved by means such as hydraulic acturators, electric motors and hand operated mechanisms into the desired positions. The obvious detriments in using such exaggerated fixes are increased drag, a demand for higher R.P.M. and more fuel. Again, in this instance, the aforementioned rooster tail often appears. The law of conservation of energy makes it apparent that power equal to that required to produce the rooster tail is being exerted against the water. Since the rooster tail provides no useful work input, the power waste is immediately apparent.

Additional to the problems and dangers encountered as a result of the noted semi-blind operation, the porpoising and general instability of prior art boats, the presence of wind and rough water or large wake conditions often result in greatly increased dangers, boats sometimes being caused to flip. This usually results when the boat, in an extremely high angle of attack encounters a wave, a wake, or a strong wind, or the bow is hit by a wind gust. Any one of these conditions can cause the bow to move upward more rapidly than usual. When such conditions assume severe proportions, the tendency is for the bow of boat to raise so high and so rapidly that the boat does a complete flip or coil, coming to rest upside down. This condition, which is often encountered, particularly in high speed boat racing activities, is hazardous in the extreme to the operator and passengers, numerous injuries and deaths having resulted from such incidents.

Boat builders and boaters alike have sought in vain for a solution to the foregoing problems.

BRIEF DESCRIPTION OF THE INVENTION

The invention described herein overcomes each of the difficulties and deficiencies noted above through what would appear, in retrospect, to be a relatively simple solution, but which has proven to be a highly effective one.

Briefly stated, each of the foregoing problems is solved by providing a properly configured stabilizer positioned in a predetermined location with respect to the stern of the boat. The resultant forces developed by the stabilizer are then transferred directly into structure attached to the stern of the boat in a manner so as to obviate the adverse characteristics otherwise inherent in the boat operation.

More specifically, a stabilizer in the nature of a foil is provided. Being generally of airfoil shape in cross section, it has positive upper camber and relatively flat or slightly negative lower camber. It is desirable for most uses that the planform of the stabilizer be of a generally delta shape, including a straight section across a relatively short portion of its leading edge. This stabilizer, when applied to an outboard motor, a stern-drive boat, or the like, is placed upon the downwardly extending post of the motor in spaced relation from and above the propeller, usually in the position normally assumed by the cavitation plate.

During operation, the action of the stabilizer is to provide an upwardly directed force or lift to the motor. The motor, attached to the transom at the stern of the boat, transfers its upwardly directed load into and thereby lifts the stern from the low-in-the-water position it normally assumes during high speed boating activites. This lifting force, by virtue of the resulting rotational force applied to boat and the resulting forward movement of the boat's center of pressure, additionally causes the bow to move downward forcing it into a normal and constant operating position almost parallel to, but slightly upwardly directed in relation to the water surface. The boat is thereby enabled to plane more quickly and efficiently than when at an extreme angle of attach. The final result is a smoother ride for passengers since porpoising is greatly decreased or eliminated, increased operator visibility with concommitantly greater safety, better controllability, significantly reduced dangers from wind gusting and wave or wake encounters, a higher boating speed, maintenance of a more consistent planing mode, a decrease in fuel consumption, and generally better handling qualities.

Objects of invention therefor include solutions to each of the foregoing problems and difficulties generally encountered in boating activities. Another object is to improve economies in boating operations so as to make that solution available to operators throughout the boating world.

Other objects of invention will be apparent upon examination of the drawings, in view of the specification and claims.

BRIEF DESCRIPTION OF THE DRAWINGS

FIG. 1 is a side view of the boat in a conventional high speed operating mode;

FIG. 2 is a side view of the boat in normal operating mode with the stabilizer of this invention applied thereto;

FIG. 3 is a side view of a typical outboard motor post and propeller in partial cutaway, the stabilizer of this invention being affixed to the post and shown in elevation;

FIG. 4 is a plan view of a typical stabilizer of this invention taken along line 4—4 of FIG. 3;

DETAILED DESCRIPTION OF THE DRAWINGS

Figure 5:
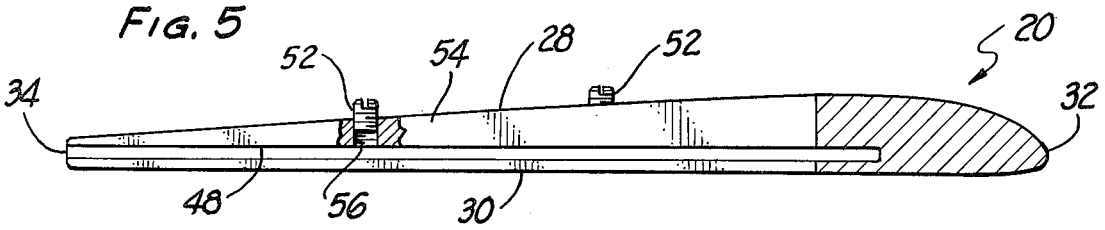
FIG. 5 is a sectional view of the stabilizer taken along line 5—5 of FIG. 4 and enlarged.
Figure 6:
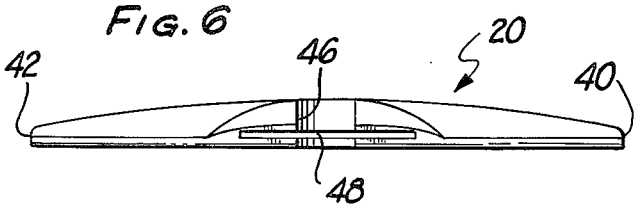
FIG. 6 is a rear view of the stabilizer taken along line 6—6 of FIG. 4.

In the drawings, an outboard motor boat 10 has mounted upon the stern thereof an outboard motor 12. The boat 10 is illustrated in the typical bow-up attitude which is inherent when boats such as that shown operate at relatively high speeds. It will be noted that the boat's relatively sharp keel 13 and, therefore, the bow 14, is completely out of the water. As shown here the water is engaged by only about fifty percent of the boat hull. This condition if often even more pronounced than illustrated. Thus, the initial engagement of water must be accomplished by the relatively flat and broad rearward portion of the boat hull. This results in a considerably higher water resistance than would be present were the boat to operate in a horizontal or level attitude, such as illustrated in FIG. 2.

Relative to FIG. 1, it will also be noted that the propeller 16 of the outboard motor 12 is deeply submerged under the water surface, its axis of rotation being at a rather severe angle in relation to the water surface, as indicated by the appearance of the rooster-tail 17.

This is in opposition to the horizontal line of thrust desired and is wasteful of power. As indicated by the arrows 18 in FIG. 1, a standard boat of the kind shown almost invariably has a tendency to porpoise or gallop, the bow bouncing upward and downward in the indicated directions, continuously slapping the water in hard blows, and as heretofore mentioned, causing considerable discomfort to the operator and passengers and greatly increasing the safety hazard.

In contrast to the operational attitude shown in FIG. 1, FIG. 2 illustrates a typical attitude for a boat, moving at the same speed as the boat of FIG. 1, but including upon the motor post 19 the stabilizer 20 of this invention. It will be noted that here the boat 10 is operating in a smooth and almost level attitude, the bow 14 being low but slightly elevated above the water surface in an efficient planing mode, thereby considerably reducing the water resistance. With the boat so oriented, the water consistently engaging about 80% to 85% of the boat's bottom surface, the otherwise galloping and hull-slapping actions encountered while operating in the manner illustrated in FIG. 1 are eliminated. Also eliminated by this difference and consistency in attitude or angle of attack are the dangerous stability and visibility problems previously mentioned which are otherwise inherent in the operation of the FIG. 1 boat. The rotational axis of the propeller 16 is also maintained essentially parallel to the water surface and to the desired direction of the force applied to the boat. The roostertail has disappeared and the efficiency of operation is materially increased.

FIGS. 3–6 are more specific and detailed illustrations of the stabilizer 20 of this invention. FIG. 3, for example, shows the stabilizer 20 in a typical embodiment and as mounted on the post in adjacently spaced relation above the propeller 16 its chord 22 being essentially parallel to the axis of rotation 24 of the propeller 16. However, it is sometimes desirable that the stabilizer 20 be disposed in a slightly upward pitch relative to the axis of rotation 24 of the propeller. This pitch control may be achieved by adjustments in the structural mounting means on the post 19 or the stabilizer 20. Additionally, an upward pitch, although not in relation to the propeller, may be achieved by rotating the motor about its mounting mechanism 25 (FIG. 2) by various conventional means.

An outboard, or a stern drive motor, irrespective of its size or configuration, invariably includes an anti-cavitation plate (referred to hereinafter as cavitation plate), such as that indicated by the numeral 26 in FIG. 3, for example. This cavitation plate 26, which is to be distinguished from those transommounted lifters, sometimes called cavitation plates, surrounds the post 19 above and in spaced relation from the propeller 16. This location has been found to substantially reduce or control propeller cavitation, i.e., the formation of vapor-filled cavities in the water in the propeller region which results when the minimum pressure at any point on the surface of a body moving through the water is lesser than the vapor pressure of the liquid at the prevailing temperature. When cavitation occurs and the propeller blades encounter the region, or air pocket, within which the vapor exists, as opposed to biting through solid water, the operational efficiency of the propeller is significantly decreased. Coincidentally, the existence of the cavitation plate in this location provides a convenient mounting position for the present stabilizer without interfering with the cavitation-controlling function of the cavitation plate, since the stabilizer also acts as the cavitation control when so mounted.

The stabilizer per se of this invention, in its most usual configuration (FIGS. 3–6), includes a cross section or profile which is generally airfoil or hydrofoil-shaped, i.e., a body shaped to provide a high lift-drag ratio, it being recognized that certain other design requirements must also be met.

As illustrated in FIG. 3, for example, the stabilizer 20 of this invention, sometimes referred to hereinafter as a foil, includes a positive camber on its upper surface 28 and, usually, a slightly negative or concave camber on its lower surface 30. This profile, slightly varied, is more specifically illustrated in FIG. 5. Although the negative camber upon the lower surface 30 is not mandatory and the stabilizer will function with reasonable efficiency with an essentially flat camber, the best efficiencies are obtained when a modest negative camber is present. For example, in a stabilizer 20 having a chord length of 11 inches, it has been found that a negative camber having a total depth approximating $\frac{1}{8}$th inch in relation to the lowest point intermediate the leading edge 32 and the trailing edge 34 gives an effective result.

As best illustrated in the plan view of FIG. 4, in its most usual configuration the stabilizer has a generally delta planform, its nose section 36 at the leading edge 32 of approximating 17% to 18% of the total width or span of the stabilizer 20. A preferred range of approximately 15% to 35% of the total span has been found to be a reasonable nose section width.

The stabilizer 20 also includes a swept leading edge 38. A sweep angle $\theta$ of 45° is illustrated in FIG. 4. A preferred range for the sweep angle $\theta$ is about from 10° to 55°.

Although not mandatory, it is generally preferable that the stabilizer tips 40 and 42 are parallel to its central axis 44. This provides a smooth operating characteristic at the foil tips as they move through the water, with less vulnerability to structural damage than would be experienced with pointed tips.

A groove 46 is provided about a central axis 44 and defined over about 75% of the chord-wise length of the stabilizer beginning at the trailing edge 34. Thus, a structural portion approximating 25% of the chord-wise length adjacent the leading edge 38 is provided for the maintenance of structural integrity. Surrounding the groove 46 and extending laterally into the body of the stabilizer is a slot 48 adapted to receive therein the relatively thin cavitation plate 26 of the motor post 19. This slot 48 is of a thickness usually slightly greater than the thickness of the cavitation plate and such that the cavitation plate slips into the slot 48 in a snug fit or nested relationship. However, in its preferred embodiment the slot 48 is sufficiently large in both its thickness and its lateral dimensions, as representatively illustrated by the dotted line 50, to accept without structural interference the cavitation plates of at least the major models of outboard, stern-mounted or other motors, whichever the case may be.

The stabilizer 20 is secured in its installed position upon the cavitation plate 26 by the simple expedient of a plurality of set screws 52. As illustrated in FIGS. 4 and 5, two such set screws 52 are provided through the upper portion 54 of the foil within threaded holes 56. Inserts, not shown, may be provided when desirable or necessary for structural integrity. Thus, by the simple expedient of using a standard screw driver, the set screws 52 may be turned into forceable engagement with the cavitation plate 26, thereby effectively retaining the stabilizer 20 in its installed position over the cavitation plate. If desired for greater holding power, indentations (not illustrated) may be provided in the upper surface of the cavitation plate to receive and seat the pointed tips of the set screws 52. By virtue of this installation, the foil is provided with a firm and structurally sound support upon the cavitation plate 26, and the motor post 19, thereby substantially increasing the resistance of the stabilizer in any tendency to fracture responsive to dynamic water forces or engagement by foreign objects.

The lifting force introduced into the foil as a result of its movement through the water, is also spread over the entire surface of the cavitation plate and transferred to the stern of the boat through the motor post 19, thereby lending further stability of operation and structural integrity to the assembly.

As viewed in FIG. 5, the slot 48 is positioned within the body of the stabilizer 20 such that the lower portion of the stabilizer surrounding that slot is narrower at the trailing edge 34 than at the forward extremity of the slot. This is sometimes desirable in lending strength to the structure. However, in the usual instance the slot is essentially parallel to the mean line of the lower surface 30.

With respect to other dimensional relationships of the various portions of the stabilizer 20, it has been found that a chordwise length approximating 75% of the span from tip 40 to tip 42 operates very effectively, and the maximum thickness of the foil being approximately 9% of the chord length. It is probable, of course, that these relative dimensions will be varied within reasonable limits for particular applications. A preferred range of dimension of the chord length to span is between 50% and 100%, although optimum results are achieved with a ratio more nearly that cited above. Similarly, with respect to maximum thickness as a function of chord length, a preferred range of from 4% to 12% has been determined.

Figure 7:
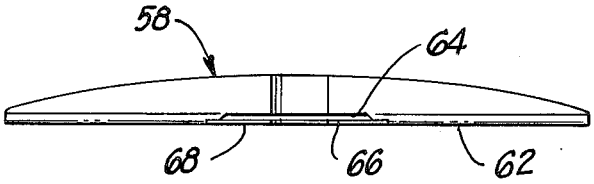
FIG. 7 is a rear view of alternate embodiment of the stabilizer taken along line 7—7 of FIG. 8.
Figure 8:
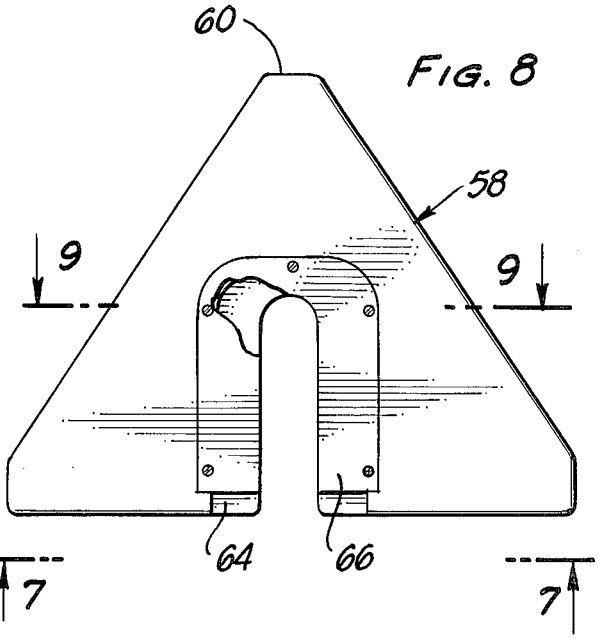
FIG. 8 is a plan view of the bottom of the alternate stabilizer configuration of FIG. 7.
Figure 9:
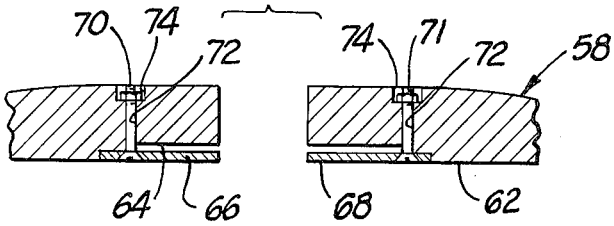
FIG. 9 is a sectional view through the stabilizer of FIG. 8, as taken along line 9—9 thereof.

An alternate embodiment of the stabilizer foil is illustrated in FIGS. 7–9, the foil therein being identified by the numeral 58. It will be noted here, that while its planform is generally similar to that illustrated in FIG. 4, the foil's nose section 60 is of slightly shorter length than the FIG. 4 embodiment, or about 10% of the span.

Another primary difference between the FIG. 8 and FIG. 4 embodiments is the attachment means. In the FIG. 8 configuration, its undersurface 62 is provided with a cavity or recessed region 64 substantially covered by a mounting plate 66 partially recessed within the cavity 64 such that its lower surface 68 is flush with the undersurface 62 of the foil.

Installation of the stabilizing foil 58 is accomplished by inserting the cavitation plate of a motor within the slot defined between the cavity 64 and the mounting plate 66, the mounting plate being then tightened upon the cavitation plate by the bolt and nut combinations 70 and 71 inserted through the holes 72 provided through the foil, the nuts being recessed within cavities 74 in the upper surface of the stabilizer which are provided for this purpose. In this instance the cavity 64 may be sufficiently wide that the bolt and nut combinations are positioned at the outer extremities of the cavitation plate, or holes (not shown) may be provided in the cavitation plate through which the bolts are inserted.

While the illustrated and described retention means have been set forth in some detail, it will be understood that other retention means may be provided so long as they are effective in retaining the stabilizer upon the cavitation plate or in a proper orientation with respect to the motor shaft and propeller.

Figure 10:
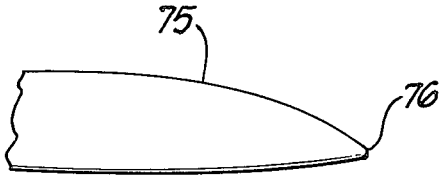
FIG. 10 is a side view of an alternate nose embodiment of the stabilizer.

The illustration of FIG. 10 is provided to more specifically define the fact that the stabilizer's leading edge may be relatively sharper and thinner than heretofore described, depending upon the particular circumstances and environment within which it is intended to operate. For example, the foil 75 having a sharp nose 76 of this character is sometimes highly desirable for high speed boat operation, such as is inherent in racing boats. In such event it is also often found desirable that the maximum thickness of the stabilizer between its cambered surfaces be minimized, thereby providing as little water resistance and introducing as little water agitation and cavitation as possible as it passes therethrough.

Figure 11:
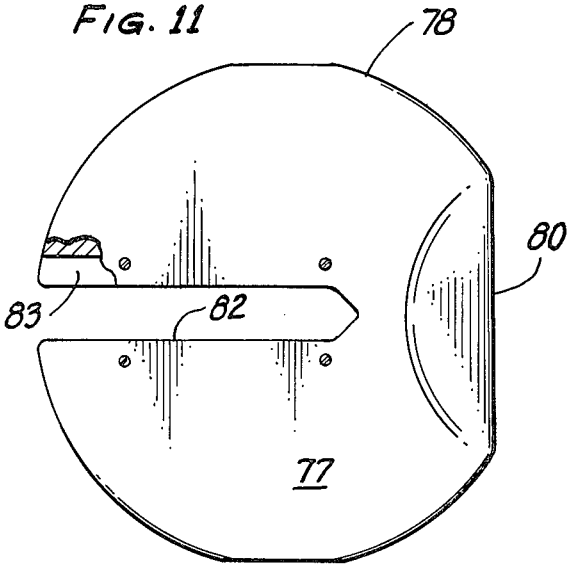
FIG. 11 is a plan view, in partial section, of a second alternate embodiment.

Again, with respect to high speed boat operation it has been found desirable that an essentially saucer-shaped stabilizer is sometimes useful, such as the stabilizer illustrated in FIG. 11. Therein, the marginal outline 78 of the stabilizer foil may be substantially round or oval, except for its straight leading edge 80. A groove 82 and a slot 83 in the stabilizer 76 are identical to those provided in the stabilizer 20 of FIGS. 3–6.

Figure 12:
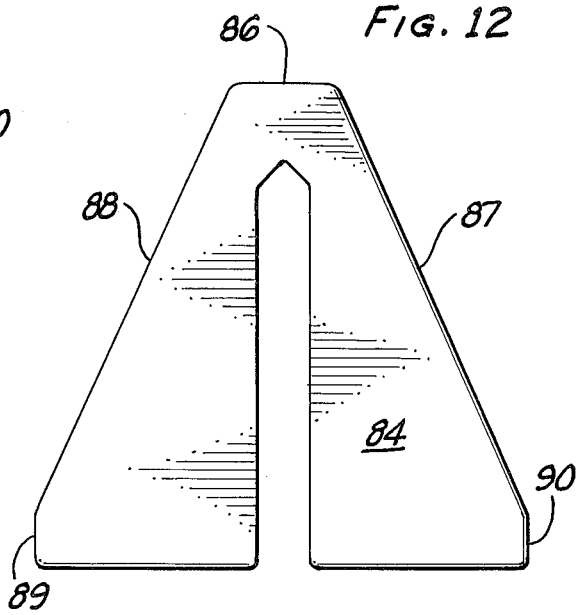
FIG. 12 is a plan view of a third alternate embodiment.

As shown in FIG. 12, a stabilizer 84 similar in planform to that of FIG. 4, has a straight nose portion 86, but is longer in its chordwise length, its leading edges 88 between the nose 86 and parallel tips 89 and 90 being swept at a greater angle than heretofore described. Again, this planform has been found effective for use of high-speed boats, and is particularly adaptable to stern drives.

Figure 13:
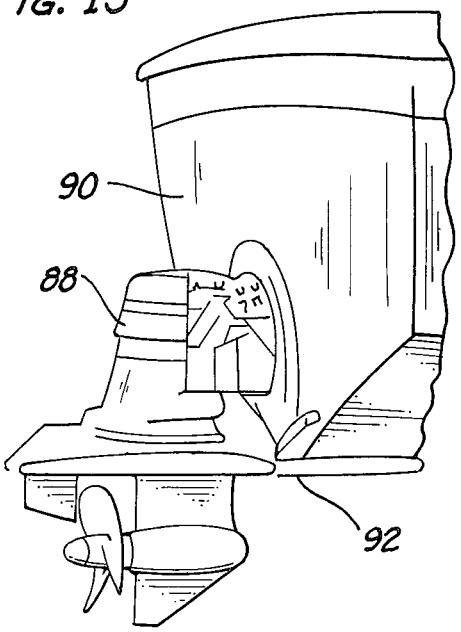
FIG. 13 is an elevational view of a stern-drive motor having the foil installed.
Figure 14:
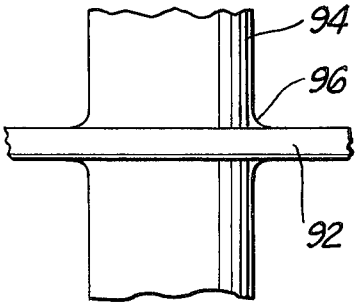
FIG. 14 is a cutaway view of a foil integrated with a motor boat post.

While this invention has been generally illustrated as being adapted to outboard motors as attachable units thereto, as previously mentioned, it can be used with equal facility, as in the FIG. 12 configuration, on stern-drive motors, as illustrated in FIG. 13. Therein, the stern drive-motor 88 is installed upon a boat 90 in the same general region indicated with respect to outboard motors. A stabilizer 92 may be provided separately and installed over the cavitation plate, as previously described, or may be included integrally with the motor per se. When installed as original and integral equipment in the manner illustrated in FIG. 14, it is cast or machined with the motor post 94. In such case, the joinder 96 between the stabilizer 92 and the post 94 is usually coved, essentially as illustrated.

By virtue of the novel characteristics of the boat stabilizer described and such stabilizer in combination with a boat motor, the objects of invention are effectively accomplished. Boats upon which such a stabilizer has been installed during operation have typically been found to attain a planing attitude much more quickly than in the absence of the stabilizer, to hold the plane without its being lost when throttling down after it is once attained and to negotiate turns with reduced RPM without losing its plane. Galloping or porpoising of the boats have been substantially reduced or eliminated and they have been found to ride much more smoothly and to operate more safely throughout both smooth and rough water conditions. The bows of such boats have also thereby maintained in a considerably improved nose-down position, as compared to boats without the stabilizer of this invention, thereby obviating their tendency to flip or roll when their bows are raised into too steep an angle of attack, particularly during consistent high winds, wind-gusting conditions, or when the boats encounter heavy waves or wakes. Additionally the need for front end ballast in boats is eliminated and lateral stability is improved. Passengers can move more freely forward and backward without too adversely affecting the boat's trim, the speed of the propeller, and therefor, the ultimate speed of the boat, is increased and the operating efficiency, i.e., miles per gallon of gasoline, is greatly improved.

In a typical application, using an 18 foot boat having a 1,500 lb. weight, with a medium load, and powered by a 120 hp. and an inboard-outboard stern drive motor, comparative results were obtained with and without the stabilizer, under otherwise identical conditions. The following results and comments were recorded.

| | Without Stabilizer | With Stabilizer |
|---|---|---|
| 1. RPM required to achieve plane | 2900 | 1750 |

-continued

| | Without Stabilizer | With Stabilizer |
|---|---|---|
| 2. RPM required to hold plane | 2400 | 1400 |
| 3. RPM at full throttle | 3900 | 4200 |
| 4. Change in bow-to-stern attitude upon load position change | Great | Slight |
| 5. Boat handling quality in tight turn | Quite steering insensitive. Skids | More sensitive steering response. Reduces skidding |
| 6. Rough water handling | Bounces, bow high | Less bounce, lower bow, knifes through water. Permits boating in rough water at higher speeds. |
| 7. General comments | | Boat is stabilized in all moments. Permits higher speeds at lower throttle under all conditions. Greater pleasure at less expense. |

It will be understood that the foregoing drawings and description are provided by way of example only and they are not to be considered as limiting upon the scope of the invention, such limitations being provided only by the scope of the claims hereinafter appended.

I claim:

1. A stabilizer capable of being fitted over a cavitation plate located on a motor post of a boat motor so as to extend outwardly around said motor post, said stabilizer comprising:

a foil member having a generally delta wing shape and including a nose portion located in front of said post, leading edges extending outwardly from opposite sides of said nose portion towards the rear of said foil member, ends located at the extremities of said leading edges remote from said nose portion and a trailing edge extending between said ends to the rear of said post, said foil member being shaped so as to provide an upwardly directed force tending to lift said stern of said boat as said motor is operated and having as a part of said shape a positively cambered upper surface, said foil member also having a groove extending between its upper and lower surfaces from said trailing edge and extending towards said nose and a slot extending into said foil member from said groove, said groove being sufficiently large so as to extend around said post, said groove and said slot being dimensioned so that said foil member is capable of being positioned on said post by being slid around said post into a position such that said anti-cavitation plate is fitted within said groove.

2. A stabilizer as claimed in claim 1 wherein:

said foil member includes means for securing said foil member to said motor post by engaging said anti-cavitation plate, said means for securing being located on said foil member.

3. A stabilizer as claimed in claim 1 wherein:

said leading edges are straight and are located at an angle of from 10° to 50° with respect to one another.

4. A stabilizer as claimed in claim 4 wherein:

said foil member includes means for securing said foil member to said motor post by engaging said anti-cavitation plate, said means for securing being located on said foil member, said leading edges are straight and are located at an angle of from 10° to 50° with respect to one another.

5. In the combination of a boat, a motor located on the stern assembly, said motor having a motor post extending downwardly from said stern, a propeller mounted on said post adjacent to the lower end thereof and an anti-cavitation plate located on and extending outwardly from said post and a stabilizer means mounted on said post the improvement which comprises:

said stabilizer means comprising a foil member located on said anti-cavitation plate, said foil member having a generally delta wing shape and including a nose portion located in front of said post, leading edges extending outwardly from opposite sides of said nose portion towards the rear of said foil member, ends located at the extremities of said leading edges remote from said nose portion and a trailing edge extending between said ends at the rear of said post, said foil member being shaped so as to provie an upwardly directed force tending to lift said stern of said boat as said motor is operated and having as a part of said shape a positively cambered upper surface, said foil member also having a groove extending between its upper and lower surfaces from said trailing edge and extending towards said nose and a slot extending into said foil member from said groove, said groove being sufficiently large so as to extend around said post, said groove and said slot being dimensioned so that said foil member is capable of being positioned on said post by being slid around said post into a position such that said anti-cavitation plate is fitted within said groove.

6. The combination claimed in claim 5 herein: said foil member includes means for securing said foil member to said motor post by engaging said anti-cavitation plate, said means for securing being located on said foil member.

7. The combination claimed in claim 5 wherein: said leading edges are straight and are located at an angle of from 10° to 50° with respect to one another.

8. The combination claimed in claim 5 wherein:

said foil member includes means for securing said foil member to said motor post by engaging said anti-cavitation plate, said means for securing being located on said foil member, said leading edges are straight and are located at an angle of from 10° to 50° with respect to one another.

* * * * *